US010669972B2

(12) United States Patent
Shebuski et al.

(10) Patent No.: US 10,669,972 B2
(45) Date of Patent: Jun. 2, 2020

(54) MAIN FUEL JET AND NOZZLE ASSEMBLY FOR A CARBURETOR

(71) Applicant: ZAMA JAPAN KABUSHIKI KAISHA, Iwate (JP)

(72) Inventors: David R. Shebuski, Franklin, TN (US); Toshiyuki Kuyo, Iwate (JP); Takumi Nonaka, Iwate (JP); Jay A. Perry, Franklin, TN (US)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 33 days.

(21) Appl. No.: 15/873,627

(22) Filed: Jan. 17, 2018

(65) Prior Publication Data

US 2019/0024613 A1 Jan. 24, 2019

Related U.S. Application Data

(63) Continuation of application No. 15/045,155, filed on Feb. 16, 2016, now Pat. No. 9,897,042, which is a continuation of application No. 14/261,214, filed on Apr. 24, 2014, now Pat. No. 9,382,876, which is a continuation-in-part of application No. 14/139,203, filed on Dec. 23, 2013, now Pat. No. 9,297,336.

(51) Int. Cl.

| | |
|---|---|
| ***F02M 17/04*** | (2006.01) |
| ***F02M 9/12*** | (2006.01) |
| ***F02M 37/02*** | (2006.01) |

(52) U.S. Cl.

CPC ..... *F02M 17/04* (2013.01); *F02M 9/121* (2013.01); *F02M 37/02* (2013.01)

(58) Field of Classification Search

CPC ..... F02M 17/04; F02M 9/12; F02M 37/02

USPC ..... 261/35, 66, 69.1, DIG. 88

See application file for complete search history.

(56) References Cited

U.S. PATENT DOCUMENTS

| | | | |
|---|---|---|---|
| 2,801,621 | A | 8/1957 | Anderson et al. |
| 4,046,844 | A | 9/1977 | Rickert |
| 6,065,739 | A | 5/2000 | Schlossarczyk et al. |
| 6,585,235 | B2 | 7/2003 | Pattullo |

(Continued)

FOREIGN PATENT DOCUMENTS

| | | |
|---|---|---|
| JP | 08-200160 | 8/1996 |
| JP | 09-053515 | 2/1997 |

(Continued)

OTHER PUBLICATIONS

JP 2014-258991 Office Action, dated Aug. 23, 2018.
JP 2014-258991 Penultimate Office Action, dated Jun. 3, 2019.

*Primary Examiner* — Robert A Hopkins
(74) *Attorney, Agent, or Firm* — One LLP

(57) ABSTRACT

A carburetor includes a body with an air intake path, a fuel pump and a fuel pressure regulator and having a main fuel jet and nozzle assembly with a main fuel jet releasably coupled to the body of the carburetor. Alternatively, a main fuel jet and nozzle assembly includes a nozzle and check valve retainer formed as a single component. In other embodiments, a carburetor is provided having a fuel pump and fuel pressure regulator positioned on the same side of the body. A fuel pump and metering chamber diaphragm sandwiched between the body of the carburetor and a pump body and cover, separates a pump chamber from a pulse chamber of the fuel pump and separates a fuel chamber from an air chamber in the fuel pressure regulator.

17 Claims, 12 Drawing Sheets

(56) References Cited

U.S. PATENT DOCUMENTS

| | | | |
|---|---|---|---|
| 2005/0031473 | A1 | 2/2005 | Nonaka |
| 2006/0151892 | A1 | 7/2006 | Tobinai |

FOREIGN PATENT DOCUMENTS

| | | |
|---|---|---|
| JP | 10-331718 | 12/1998 |
| JP | 2000-257508 | 9/2000 |

MAIN FUEL JET AND NOZZLE ASSEMBLY FOR A CARBURETOR

CROSS-REFERENCE TO RELATED APPLICATION

This application is a continuation of U.S. application Ser. No. 15/045,155, filed Feb. 16, 2016, which is a continuation of U.S. application Ser. No. 14/261,214, filed Apr. 24, 2014, now U.S. Pat. No. 9,382,876, which is a continuation-in-part of U.S. application Ser. No. 14/139,203, filed Dec. 23, 2013, now U.S. Pat. No. 9,297,336, all of which are incorporated herein by reference.

FIELD

The embodiments described herein relate to a diaphragm carburetor and, more particularly, to a diaphragm carburetor having a main fuel jet releasably coupled to the body of the carburetor.

BACKGROUND

A diaphragm-type carburetor is employed, as are most carburetors, to supply fuel to an internal combustion engine, particularly, to such an engine having a limited displacement. Diaphragm carburetors are generally used to supply fuel to two-cycle engines. These carburetors are equipped with a fuel pressure regulator that ensures fuel fed from a fuel pump is regulated at a fixed pressure, and then delivered to an air intake path. The fuel pressure regulator is typically equipped with a constant-pressure fuel chamber that stores fuel sent from the fuel pump. The constant-pressure or metering fuel chamber is generally separated from atmosphere by a diaphragm that adjusts the fuel pressure to a constant pressure. A control valve that is interlocked to the motion of the diaphragm opens and closes a fuel passageway through which fuel flows to the fuel chamber. Fuel from the fuel chamber is delivered to the air intake path via a main fuel path and an idle fuel path. The main fuel path leads to a main nozzle that is open to a venturi in the air intake path. The idle fuel path leads to slow and idle ports that open adjacent to a throttle valve in the air intake path.

Referring to FIG. 1, a prior art carburetor having a fuel supply and control circuit is shown. The carburetor 1 includes a body 2 with an air intake path 5 that extends horizontally, and covers 3 and 4 mounted on the top and bottom of the body 2. The intake path 5 has a venturi 6 and a throttle valve 7 mounted upstream of the venturi 6.

A fuel pump diaphragm 9 of a fuel pump 8 is sandwiched between the body 2 of the carburetor 1 and the top cover 3. Fuel in a fuel tank (not shown) passes from a fuel pipe 10 through an inlet valve 11, an inlet chamber 12, a pump chamber 13, an outlet valve 14, and an outlet chamber 15, and is fed, via a fuel path 17 to a metering or constant-pressure fuel chamber 20 of a fuel pressure regulator 18. A pulse pressure generated in an engine crankcase is introduced into a pulse chamber 16 which opposes a pump chamber 13 (both of which sandwich the fuel pump diaphragm 9), which causes the fuel to be sucked into the pump chamber 13, from which it is dispensed, all of which is generally known in the art.

A metering diaphragm 19 of a fuel pressure regulator 18 is sandwiched between the body 2 and the bottom cover 4 of the carburetor 1, and separates the fuel chamber 20 above from an air chamber 21 below. A lever 23, which is housed in the fuel chamber 20 and supported in free rotation by a pin 22, is biased by a spring 24 so one end 23*a* of the lever 23 contacts the center of the metering diaphragm 19. At the other end 23*b*, the lever 23 supports an inlet needle 25 of a fuel control valve 33 that opens and closes the fuel path. 17. When the pressure drops in the fuel chamber 20 as fuel is fed from the chamber 20 into the air intake 5, the metering diaphragm 19 is biased upward, biasing the inlet needle 25 downward or away from the control valve 33 to open the control valve 33 and allow fuel to flow through the fuel path 17 into the fuel chamber 20. When the pressure rises in the fuel chamber 20 due to the flow of fuel into the chamber 20, the metering diaphragm 19 is biased downward, biasing the inlet needle 25 upward or toward the control valve 33 to close the control valve 33. In this manner, the fuel chamber 20 is always kept at a constant pressure.

The fuel from the fuel chamber 20 enters a nozzle chamber 27 via a main fuel path 26. The fuel is fed from the nozzle chamber 27 to the air intake path 5 through a main nozzle 28 that opens into the venturi 6 of the air intake path 5. The fuel from the fuel chamber 20 also enters a port chamber 30 via an idle fuel path 29. Depending on the position of the throttle valve 7, the fuel is fed from the port chamber 30 into the air intake path 5 through an idle port 31 or part throttle ports 32 adjacent to the throttle valve 7.

In conventional diaphragm carburetors, such as the prior art carburetor shown in FIG. 1, a main fuel jet is fixedly mounted within the carburetor body. Thus, it would be desirable to provide a carburetor with a main fuel jet that is releasably coupled to the body of the carburetor.

SUMMARY

The embodiments provided herein are directed to a carburetor having a main fuel jet and nozzle assembly wherein the main fuel jet is releasably coupled to the body of the carburetor. In an alternative embodiment, a main fuel jet and nozzle assembly includes a nozzle and check valve retainer formed as a single component.

In other embodiments, a carburetor is provided having a single diaphragm for supplying and metering fuel. In one embodiment, a carburetor includes a body with an air intake path and a pump cover or body and cover mounted on one side of the body. A fuel pump and metering chamber diaphragm is sandwiched between the body and the pump body and cover, and separates a pump chamber and a pulse chamber of a fuel pump, and also separates a fuel chamber above from an air chamber below the fuel pump and metering diaphragm in a fuel pressure regulator. The pulse chamber and the constant pressure fuel chamber are formed in the body of the carburetor on the same side of the carburetor. The pump chamber and the air chamber are formed in the pump cover. A gasket interposes the diaphragm and the pump cover.

In one embodiment, the diaphragm includes a pump portion and a metering portion. In another embodiment, the diaphragm includes a first portion comprising the pump portion and a second portion comprising a metering portion. In another embodiment, the diaphragm includes an inlet flapper valve and an outlet flapper valve. In yet another embodiment, a flapper valve member interposes the diaphragm and the body of the carburetor, wherein the flapper valve member includes an inlet flapper valve and an outlet flapper valve.

The systems, methods, features and advantages of the invention will be or will become apparent to one with skill in the art upon examination of the following figures and detailed description. It is intended that all such additional methods, features and advantages be included within this description, be within the scope of the invention, and be protected by the accompanying claims. It is also intended that the invention is not limited to require the details of the example embodiments.

BRIEF DESCRIPTION OF THE FIGURES

The accompanying drawings, which are included as part of the present specification, illustrate the presently preferred embodiment and, together with the general description given above and the detailed description of the preferred embodiment given below, serve to explain and teach the principles of the present invention.

Figure 1:
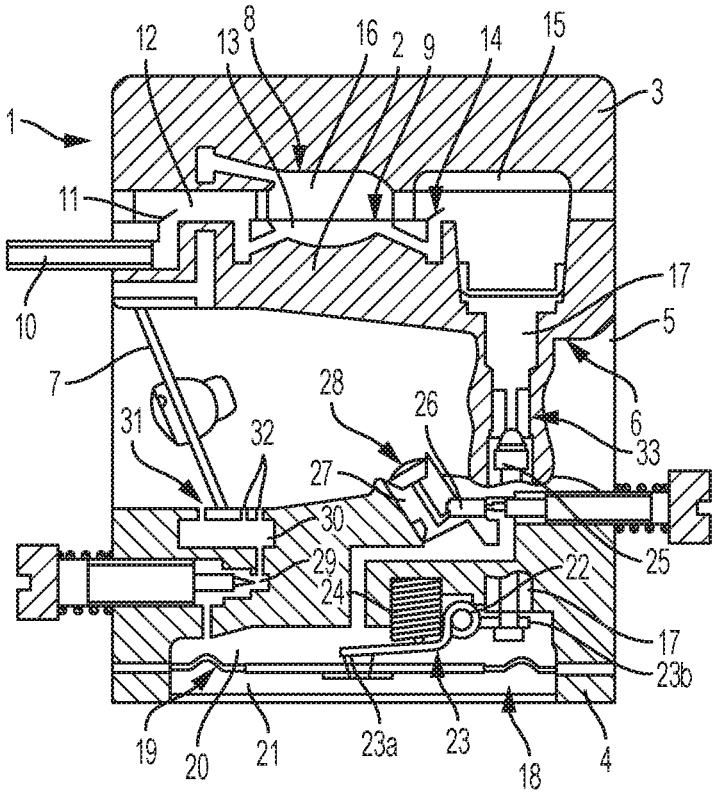
FIG. 1 is a cross-sectional plan view of a conventional diaphragm carburetor having a fuel pump and a metering chamber.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not necessarily describe every aspect of the teachings disclosed herein and do not limit the scope of the claims.

DESCRIPTION

The embodiments provided herein are directed to a carburetor have a single diaphragm for supplying and metering fuel. In conventional diaphragm carburetors, such as the prior art carburetor shown in FIG. 1, two separate diaphragms and two separate pump covers are utilized to supply and meter fuel.

Figure 2:
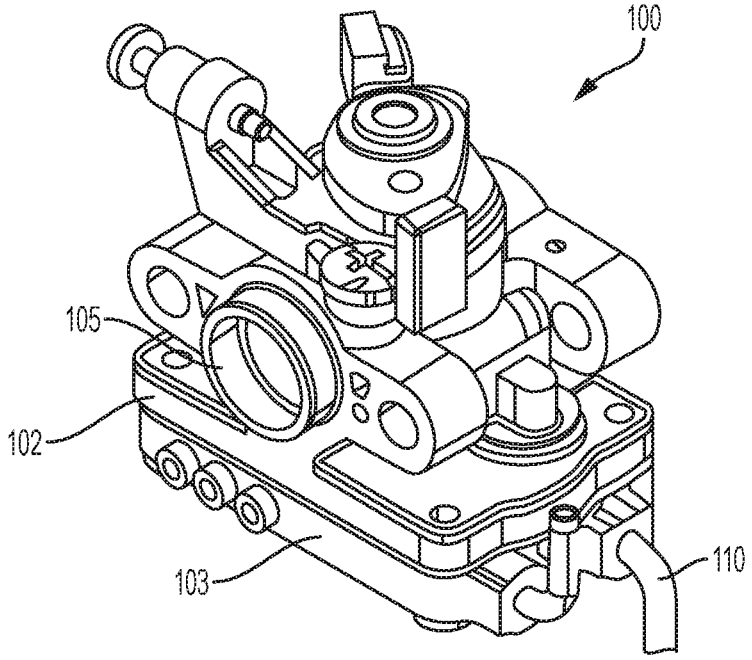
FIG. 2 is perspective view of an embodiment of a carburetor having a single diaphragm for supplying and metering fuel.
Figure 3:
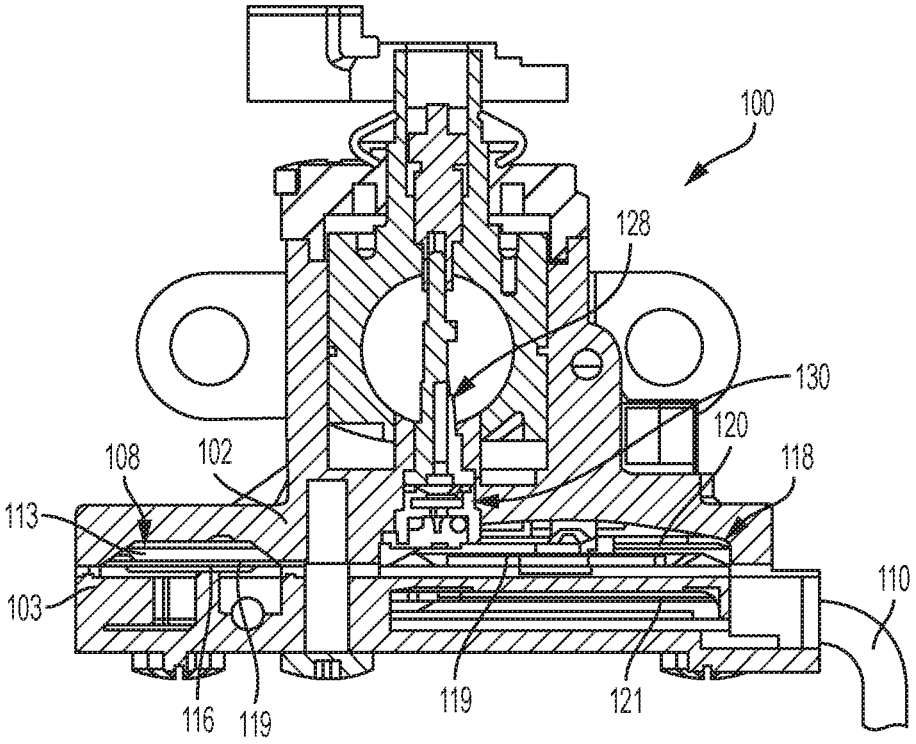
FIG. 3 is a cross-sectional plan view of carburetor shown in FIG. 2.

As depicted in FIGS. 2 and 3, an embodiment of a carburetor 100 provided herein includes a body 102 with an air intake path 105 that extends horizontally, and a pump body and cover 103 mounted on the bottom of the body 102.

A fuel pump and metering chamber diaphragm 119 is sandwiched between the body 102 of the carburetor 100 and the pump body and cover 103. Fuel in a fuel tank (not shown) passes from a fuel pipe 110 through an inlet valve 111 (see FIG. 11), a pump chamber 116 of a fuel pump 108, and an outlet valve 114 (see FIG. 11), and is fed, via a fuel path to a metering or constant-pressure fuel chamber 120 of a fuel pressure regulator 118. A pulse pressure generated in an engine crankcase (or in the case of a four cycle, the pulse is created in the intake runner by the opening of the intake valve) is introduced from a pulse passage 115 into a pulse chamber 113 above a pump portion 119*a* of the fuel pump and metering chamber diaphragm 119 and which opposes the pump chamber 116 below the pump portion 119*a* of the fuel pump and metering chamber diaphragm 119, which causes the fuel to be sucked into the pump chamber 116, from which it is dispensed in a manner generally known in the art.

Figure 4:
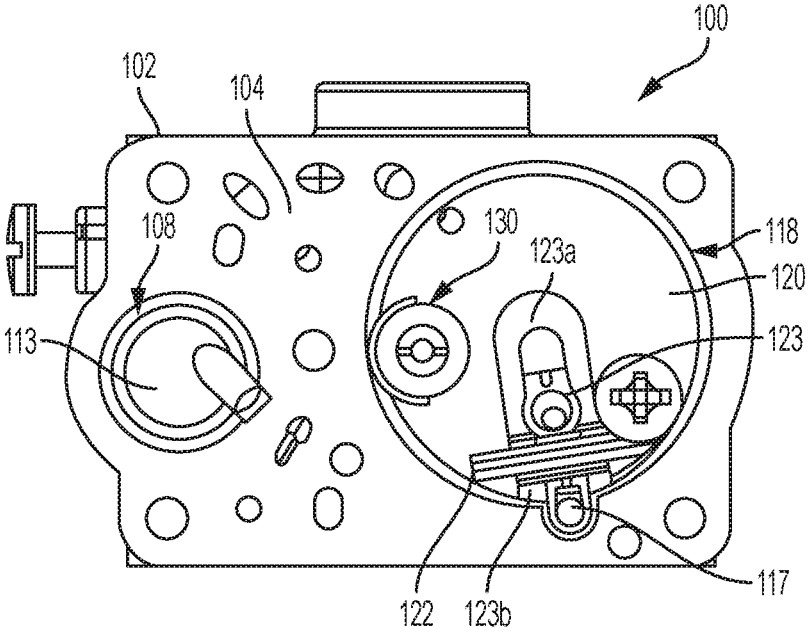
FIG. 4 is a bottom view of a body of the carburetor shown in FIG. 2.

The fuel pump and metering diaphragm 119, which is sandwiched between the body 102 and the pump body and cover 103 of the carburetor 100, also separates a fuel chamber 120 above from an air chamber 121 below the fuel pump and metering diaphragm 119 in a fuel pressure regulator 118. As shown in FIG. 4, a lever 123, which is housed in the fuel chamber 120 and supported in free rotation by a pin 122, is biased by a spring so one end 123*a* of the lever 123 contacts the center of a metering portion 119*b* of the fuel pump and metering diaphragm 119. At the other end 123*b*, the lever 123 supports an inlet needle of a fuel control valve that opens and closes a fuel path. When the pressure drops in the fuel chamber 120 as fuel is fed from the chamber 120 into the air intake 105, the metering portion 119*b* of the fuel pump and metering diaphragm 119 is biased upward, biasing the inlet needle downward or away from the control valve to open the control valve and allow fuel to flow through the fuel path into the fuel chamber 120. When the pressure rises in the fuel chamber 120 due to the flow of fuel into the chamber 120, the metering portion 119*b* of the fuel pump and metering diaphragm 119 is biased downward, biasing the inlet needle upward or toward the control valve to close the control valve. In this manner, the fuel chamber 120 is always kept at a constant pressure.

Figure 5:
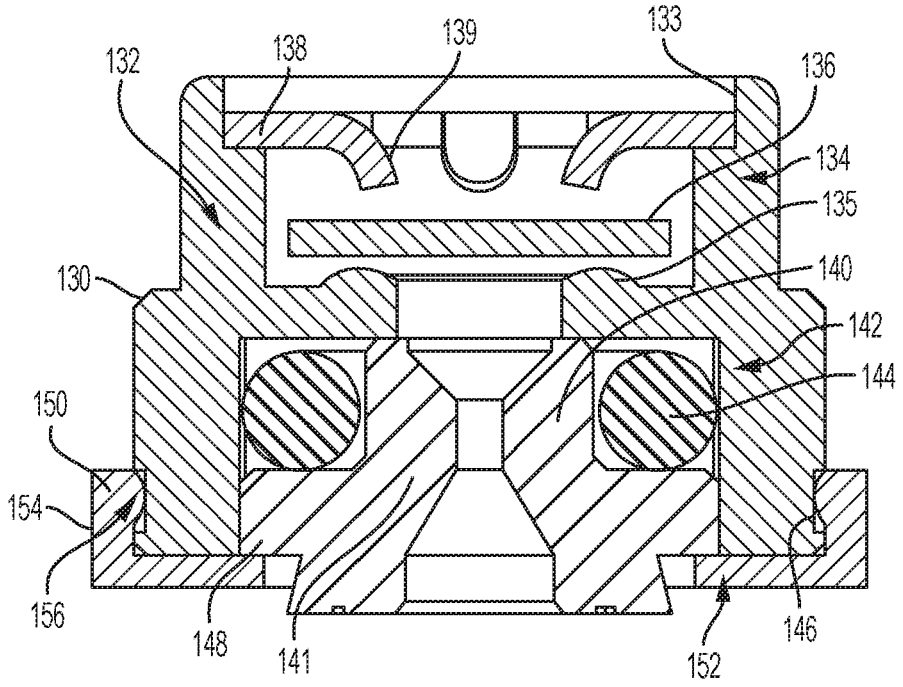
FIG. 5 is a sectional profile view of a main fuel jet assembly for use with the carburetor shown in FIGS. 1, 2, 3, 4, 14, 15 and 19.
Figure 6:
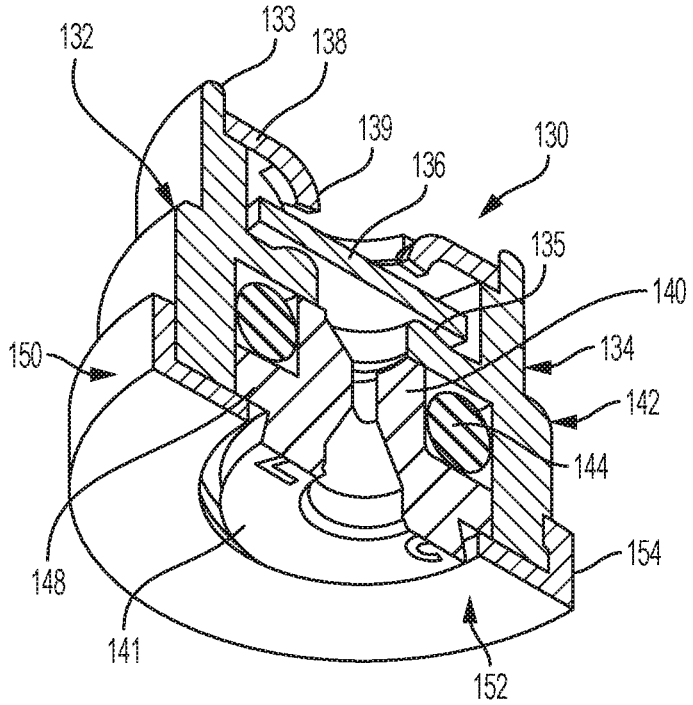
FIG. 6 is a perspective sectional profile view of a main fuel jet assembly for use with the carburetor shown in FIGS. 1, 2, 3, 4, 14, 15 and 19.

The fuel from the fuel chamber 120 is fed to the air intake path 105 through a main nozzle 128 that opens into the venturi of the air intake path 105 in a manner generally known in the art. Turning to FIG. 4, a bottom side 104 of the carburetor body 102 of the carburetor 100 is shown to have a fuel chamber 120 of a fuel pressure regulator 118 and a pulse chamber 113 of a fuel pump 108 cast therein. A main fuel jet assembly 130 is shown in FIGS. 3 and 4 mounted within the body 102 of the carburetor 100. As shown in FIGS. 5 and 6, the main fuel jet assembly 130 includes a check valve assembly 132, a main fuel jet 140, and a jet retainer 150 releasably coupling the main fuel jet 140 to the check valve assembly 132. The check valve assembly 132 includes a valve body 134 having an annular shape with a valve seat 135 extending inwardly toward the center of the body 134 and a check valve plate 136 having a circular shape positioned within the valve body 134 above the valve seat 135. A check valve retainer 138 with an annular shape is seated in a recess 133 formed in the valve body 134 at an end opposite the valve seat 135. A plurality of check valve stops 139 are positioned about the inner periphery of the check valve retainer 138 and extend axially toward the valve seat 135. A base of the nozzle 128 is also received in the receptacle 133 such that the nozzle 128 retains the check valve retainer 138 seated in the recess 133.

A jet receptacle 142 having an annular shape is integrally formed with and axially extending from the valve body 134 at an end opposite the check valve retainer 138. The valve body 134 and jet receptacle 142 are press fit into a receiving hole in the body 102 of the carburetor 100. The main fuel jet 140 includes a body 141 having a laterally extending wing 148 comprising one or more wings positioned about the periphery of the body. An o-ring 144 is positioned about the body 141 of main fuel jet 140 and abuts the valve seat 135 and the wing 148 of the body 141 of the main fuel jet 140 as the jet retainer 150 releasably retains the main fuel jet 140 in the jet receptacle 142.

The retainer 150 is preferably formed from plastic and includes an annular base 152 with an annular retaining arm 154 extending up from the base 152. Alternatively, the retaining arm 154 may include a plurality of arcuate arms extending up from the base 152. Adjacent an end of the retaining arm 154 opposite the base 152 is a detent 156 which engages an annular detent pocket 146 formed about the exterior of the jet receptacle 142 extending beyond the body 102 to releasably retain the main fuel jet 140 in the jet receptacle 142. The detent 156 may be a continuous annular detent or a plurality of detents formed about the internal periphery of the retaining arm 154. With such a configuration, the main fuel jet 140 can be easily removed and replaced as needed for different engine sizes, performance needs, changes in altitude, and different fuels.

Figure 7A:
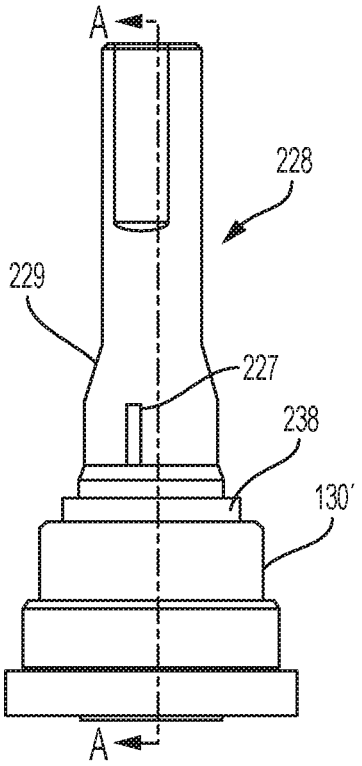
FIGS. 7*a* and 7*b* are profile and sectional profile views of a main fuel jet and nozzle assembly for use with the carburetor shown in FIGS. 1, 2, 3, 4, 14, 15 and 19.
Figure 7B:
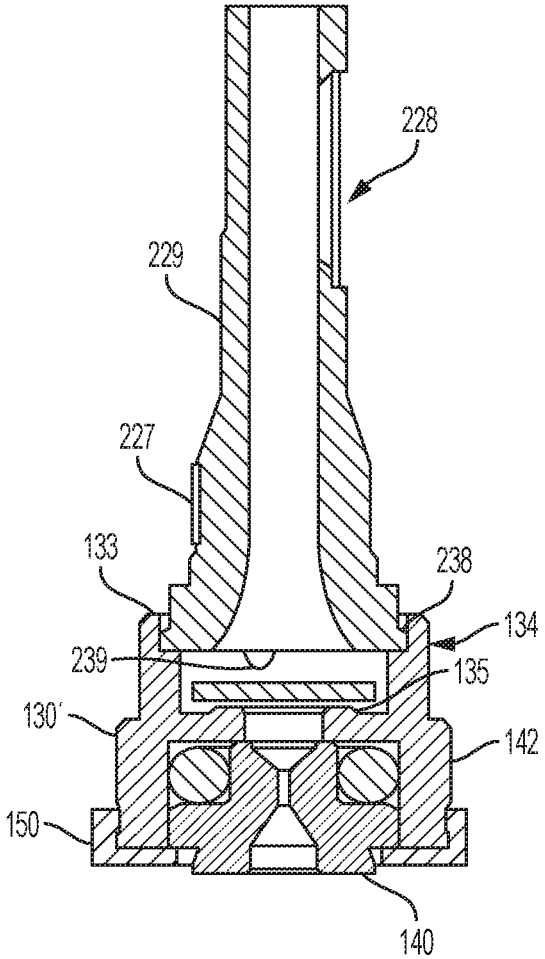
Figure 8A:
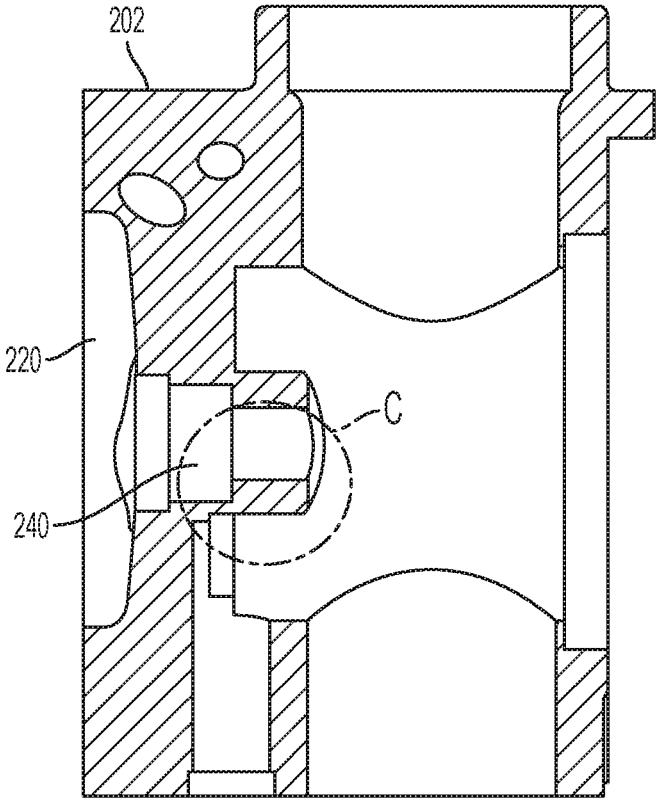
FIG. 8*a* is a sectional detail view of the carburetor body showing a hole for mounting a main fuel jet and nozzle assembly.
Figure 8B:
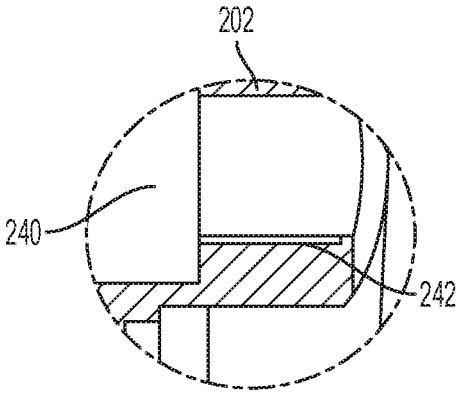
FIG. 8*b* is a sectional detail view of the hole in the carburetor body taken along line C.

In an alternative embodiment, as shown in FIGS. 7*a* and 7*b*, a nozzle 228 combines the check valve retainer 138, shown in FIGS. 5 and 6, and the nozzle 128, shown in FIG. 3, as a single component via single piece construction. The nozzle 228, which is shown coupled to a main fuel jet assembly 130' having the same components as the main fuel jet assembly 130 shown in FIGS. 5 and 6, includes a nozzle body 229 extending up from an annular base 238. The annular base 238 is received in the recess 133 of the check valve body 124. A plurality of check valve stops 239 are positioned about the inner periphery of the annular base 238 and extend axially toward the valve seat 135. The body 229 of the nozzle 228 further comprises an elongate positioning rib 227 sized and configured to engage a positioning channel 242 formed in the carburetor body 102. As shown in FIGS. 8*a* and 8*b*, a hole 240 for mounting the main fuel jet assembly 130' and nozzle 228 in the carburetor body 202, extends into the body 202 from a fuel chamber 220 formed in the body 202, and includes the positioning channel 242.

Figure 9:
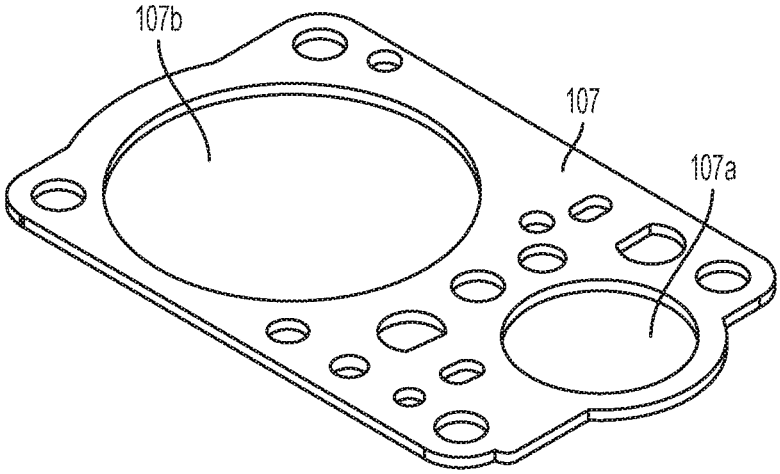
FIG. 9 is a perspective view of a gasket.
Figure 10:
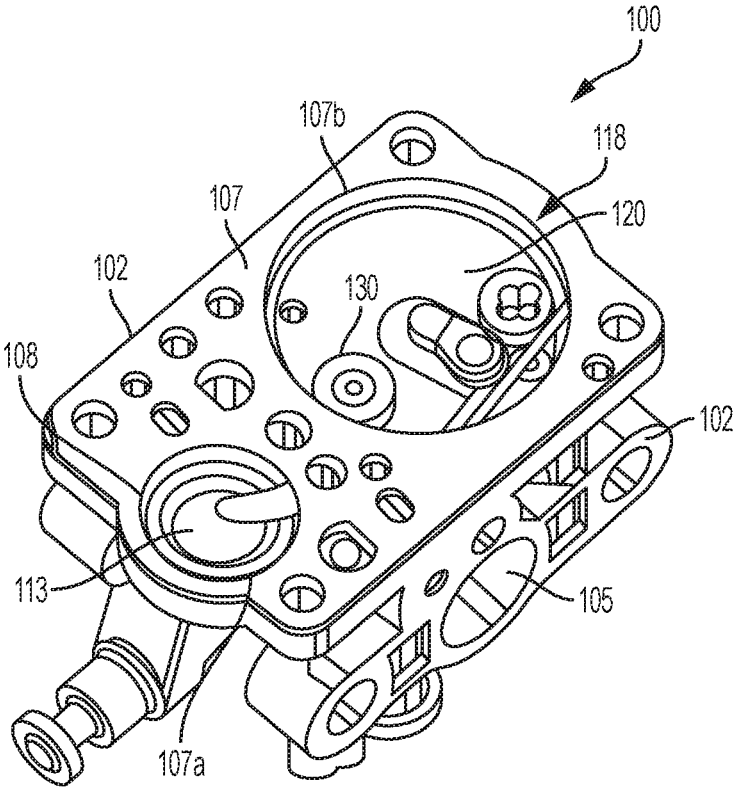
FIG. 10 is a perspective view of the gasket mounted on the bottom of the body of the carburetor shown in FIG. 4 to show align of the gasket relative to the body.

Turning to FIGS. 9 and 10, a gasket 107 is shown with pump and metering openings 107*a* and 107*b*. As depicted in FIG. 10, the pump and metering openings 107*a* and 107*b* of the gasket 107 align with the pulse and fuel chambers 113 and 120 on the bottom side 104 of the carburetor body 102.

Figure 11:
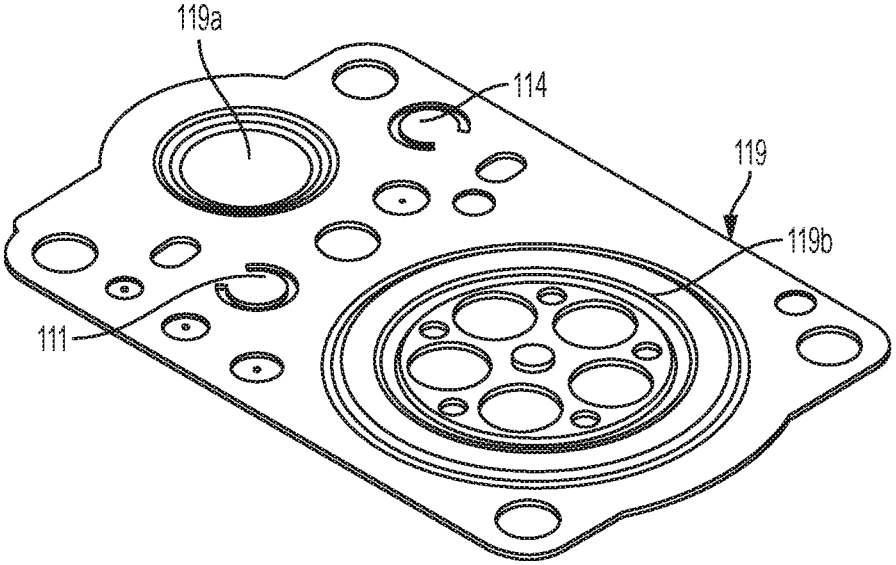
FIG. 11 is a perspective view of an embodiment of a pump and metering diaphragm.

A pump and metering diaphragm 119 is depicted in FIG. 11. The pump and metering diaphragm 119 includes a pump portion 119*a*, a metering portion 119*b* and integral inlet and outlet flapper valves 111 and 114. The pump portion 119*a* is configured to handle the high positive and negative crankcase pulse pressures to draw fuel into and dispense fuel from the pump chamber 116. The metering portion 119*b* is configured to operate at atmospheric pressure and be biased against the fuel chamber 120 to maintain a constant fuel pressure in the fuel chamber 120.

Figure 12:
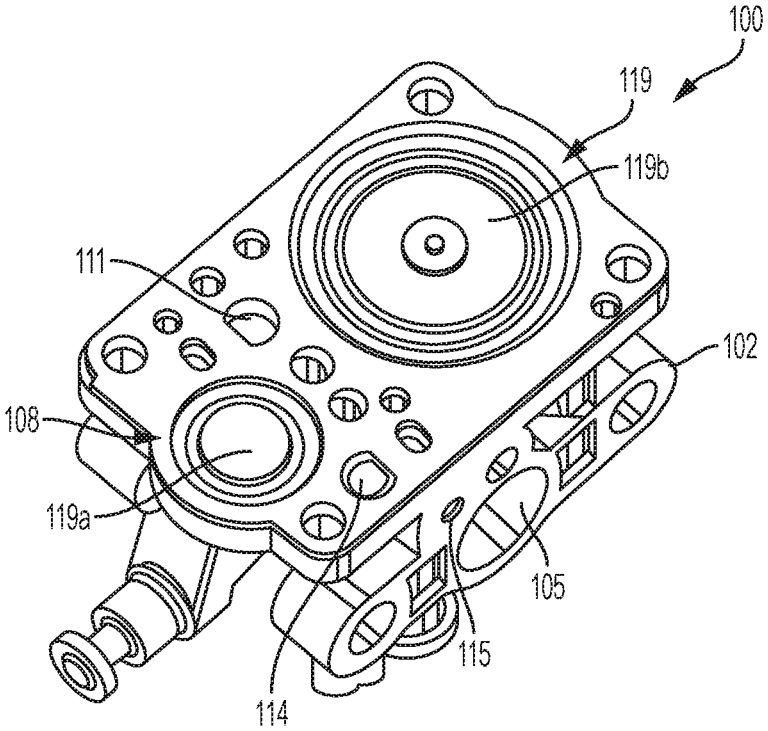
FIG. 12 is a perspective view of the diaphragm mounted under the gasket and on the bottom of the body of the carburetor.

As shown in FIG. 12, the pump and metering diaphragm 119 mounts against the bottom side 104 of the carburetor body 102 under the gasket 107 with the pump and metering portions 119*a* and 119*b* aligned with the pulse and fuel chambers 113 and 120.

Figure 13:
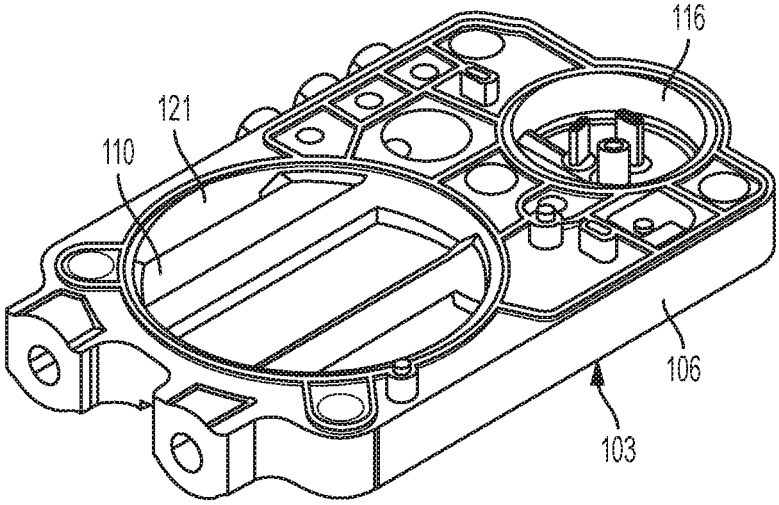
FIG. 13 is a perspective view of a pump body and cover.
Figure 14:
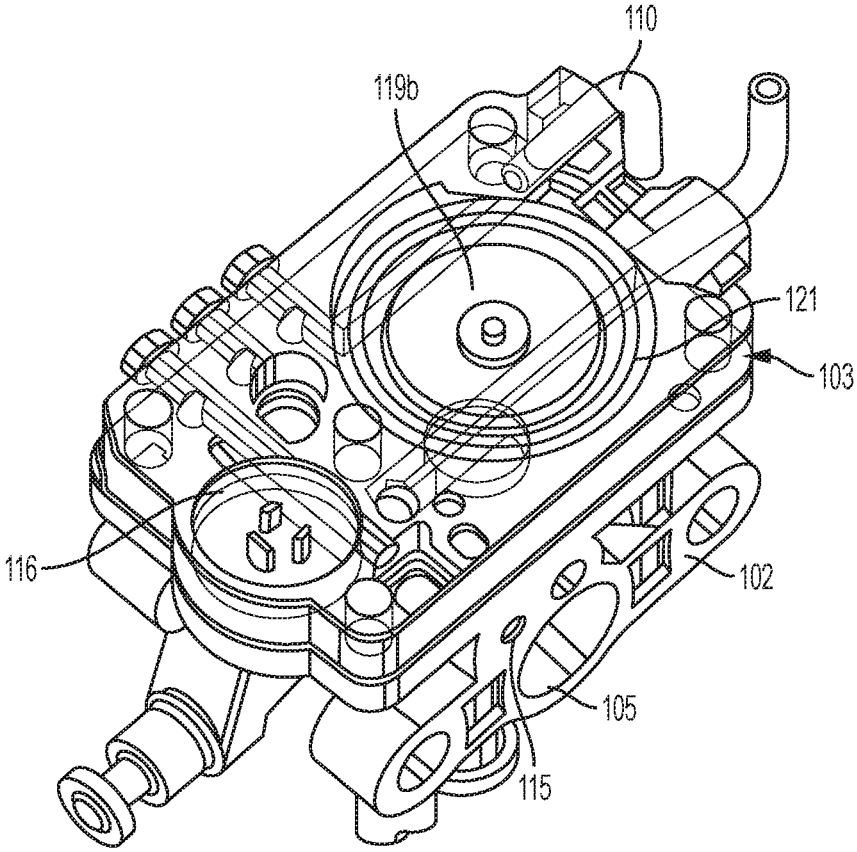
FIG. 14 is a perspective view of the pump body and cover mounted over the diaphragm and gasket and on the bottom of the body of the carburetor, gasket and diaphragm assembly shown in FIG. 10.
Figure 15:
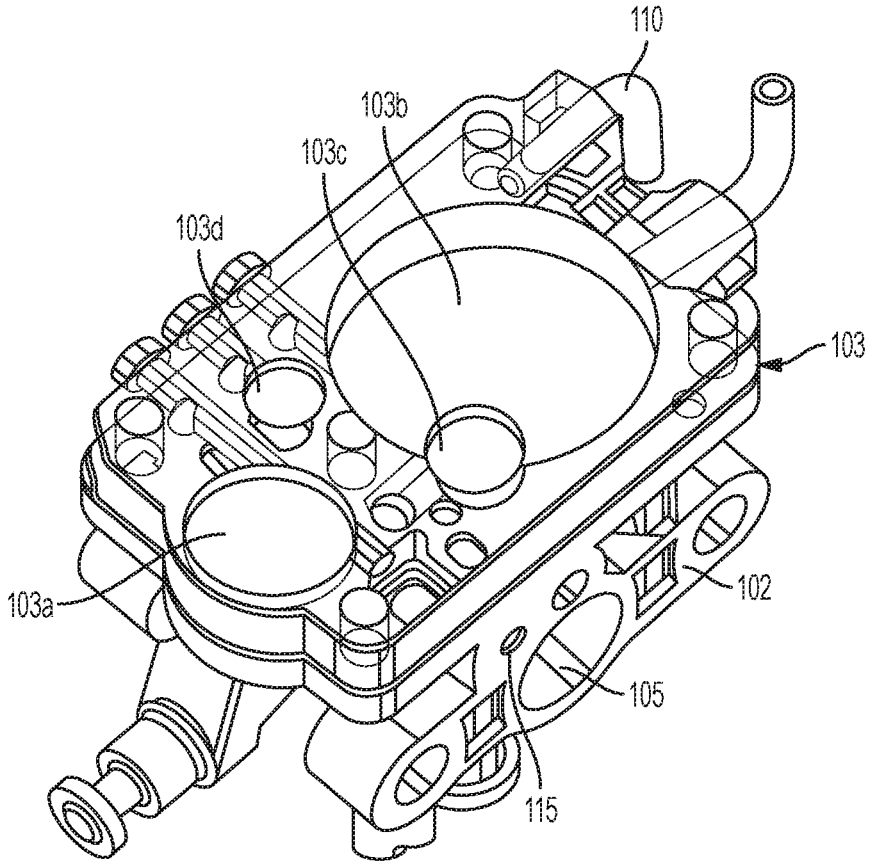
FIG. 15 is a perspective view of the carburetor shown in FIG. 12 with full cover.
Figure 16:
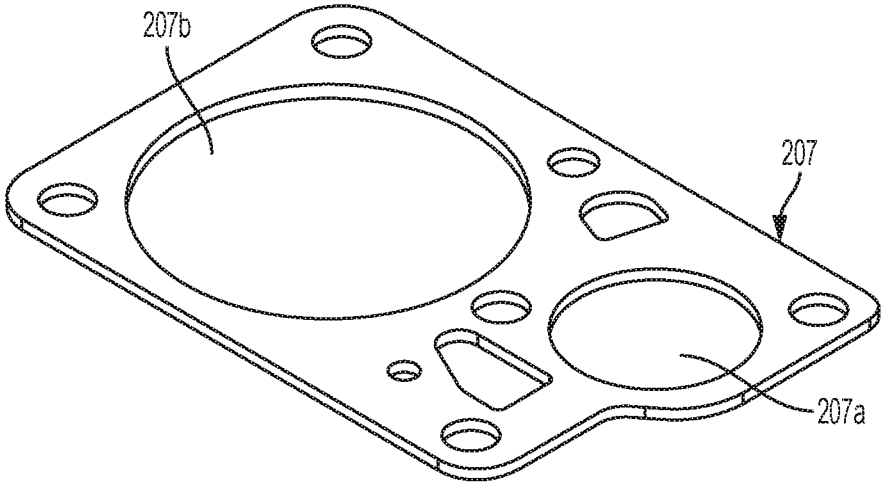
FIG. 16 is a perspective view of a gasket of an alternative embodiment.
Figure 17:
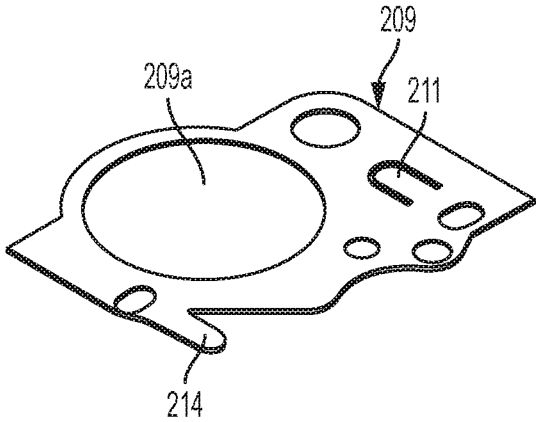
FIG. 17 is a perspective view of a flapper valve member of an alternative embodiment.
Figure 18A:
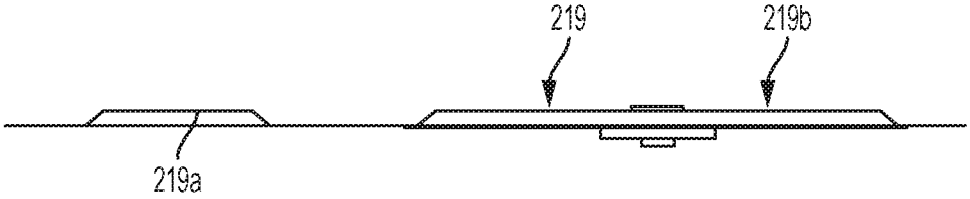
FIGS. 18*a* and 18*b* are an elevation side and plan views of an alternative embodiment of a pump and metering diaphragm.
Figure 18B:
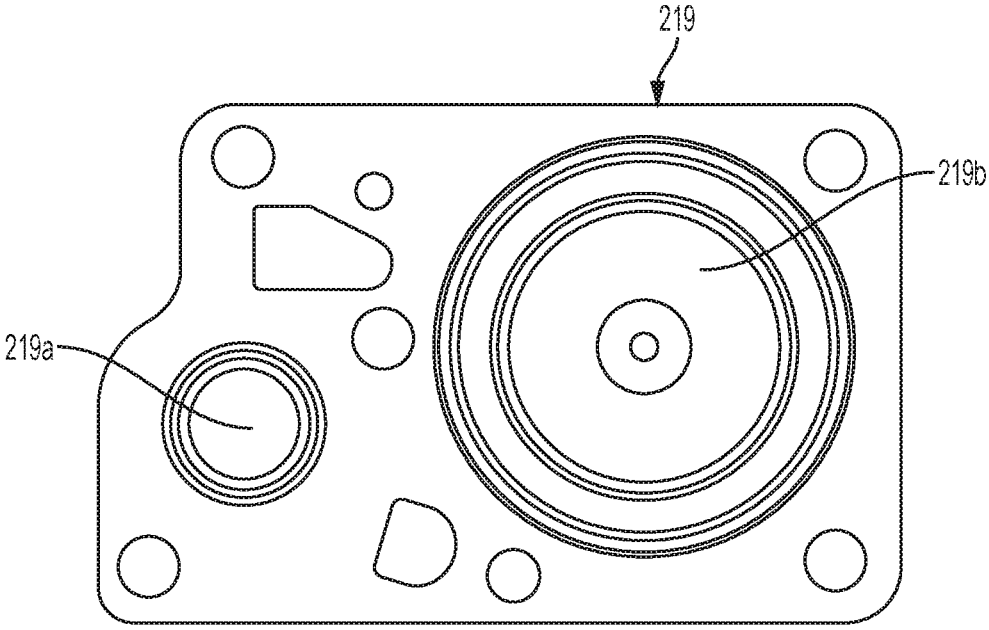

A pump body and cover 103 is shown in FIG. 13. An air chamber 121 of a fuel pressure regulator 118 and a pump chamber 116 of a fuel pump 108 are formed in a body 106 of the pump body and cover 103. The body 106 includes a fuel passage 110 formed therein. As shown in FIGS. 14 and 15, the pump body and cover 103 is mountable on the bottom side 104 of the carburetor body 102 over the pump and metering diaphragm 119 with the gasket 107 positioned between the pump body and cover 103 and the pump and metering diaphragm 119. The pump chamber 116 and the air chamber 121 of the pump body and cover 103 are aligned with the pump and metering portions 119*a* and 119*b* of the pump and metering diaphragm 119 and the pulse and fuel chambers 113 and 120. Cover portions 103*a*, 103*b*, 103*c* and 103*d* are shown in place in FIG. 15.

Alternatively, as shown in FIGS. 16, 17, 18*a* and 18*b*, a separate flapper valve member 209 interposes the bottom side 104 of the body and a pump and metering diaphragm 219. The flapper valve member 209 includes a pump opening 209*a* and integral inlet and outlet flapper valves 211 and 214. The flapper member 209 is mountable against the bottom side 104 of the carburetor body 102 with the pump opening 209*a* alignable with the pulse chamber 113. The flapper valve member 209 is made from a gasket material or a suitably flexible plastic material.

The pump and metering diaphragm 219 includes a pump portion 219*a* and a metering portion 219*b*. The pump and metering diaphragm 219 mounts on the bottom side 104 of the carburetor body 102 over the flapper valve member 209 with the pump and metering portions 219*a* and 219*b* aligned with the pulse and fuel chambers 113 and 120. A gasket 207 includes pump and metering openings 207*a* and 207*b*. The gasket 207 is mountable on the bottom side 104 of the carburetor body 102 over the flapper valve member 209 and the pump and metering diaphragm 219 with the pump and metering openings 207*a* and 207*b* alignable with the pulse and fuel chambers 113 and 120.

By placing the fuel pump and metering chamber 108 and 118 on one side of the carburetor body 102, one of the metering chamber or fuel pump diaphragms and one of the metering chamber or fuel pump covers can be eliminated, which advantageously reduces material and labor costs, and also reduces the overall size or footprint of the carburetor.

Figure 19:
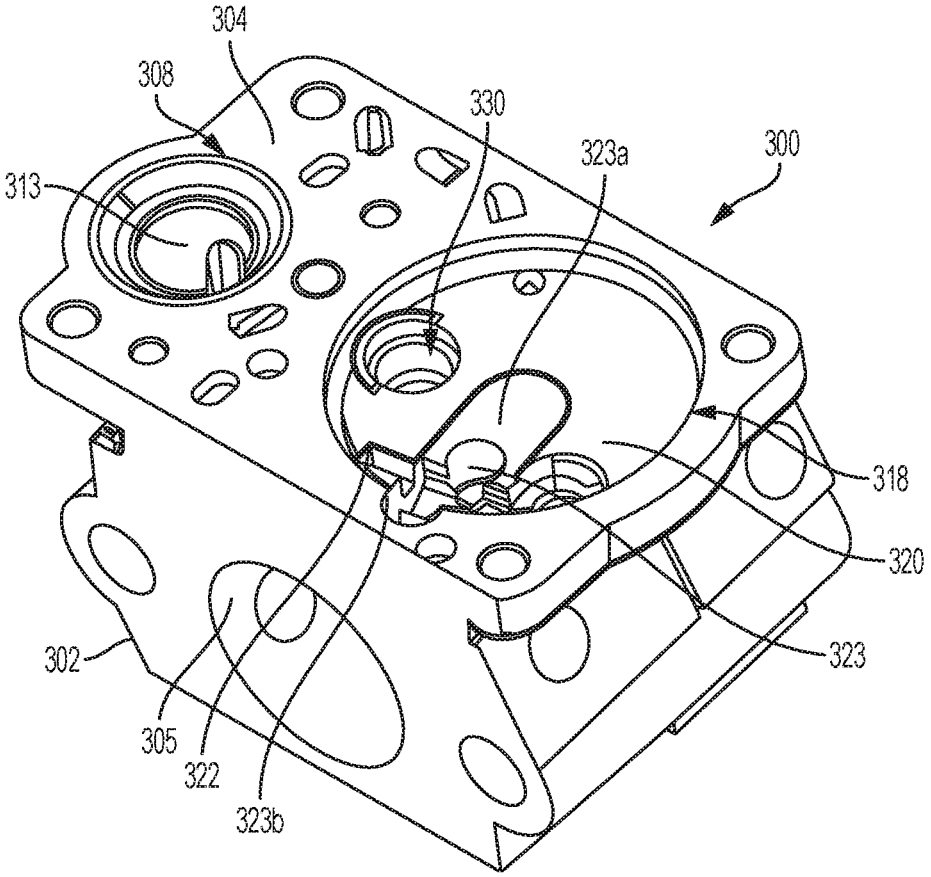
FIG. 19 is a perspective view of a carburetor of an alternative embodiment.

As depicted in FIG. 19, an alternate embodiment of a carburetor 300 is provided herein to be utilized with the diaphragms, gaskets, flapper valve, and pump body and cover shown in FIGS. 9, 11, 13, and 16-18 and configured accordingly. The carburetor 300 includes a body 302 with an air intake path 305 that extends horizontally. The air intake path includes a venturi and a throttle valve which is mounted within the air intake path downstream of the venturi. Fuel in a fuel tank passes (as shown in FIG. 1) from a fuel passage, and a pump chamber of a fuel pump 308, and is fed, via a fuel path to a metering or constant-pressure fuel chamber 320 of a fuel pressure regulator 318. A pulse pressure generated in an engine crankcase is introduced from a pulse passage into a pulse chamber 313 above a pump portion of the fuel pump and metering chamber diaphragm and which opposes the pump chamber below the pump portion of the fuel pump and metering chamber diaphragm, which causes the fuel to be sucked into the pump chamber, from which it is dispensed in a manner generally known in the art.

The fuel pump and metering diaphragm, which is sandwiched between the body 302 and the pump body and cover of the carburetor 300, also separates a fuel chamber 320 above from an air chamber below the fuel pump and metering diaphragm in a fuel pressure regulator 318. A lever 323, which is housed in the fuel chamber 320 and supported in free rotation by a pin 322, is biased by a spring so one end 323*a* of the lever 323 contacts the center of a metering portion of the fuel pump and metering diaphragm. At the other end, the lever 323 supports an inlet needle of a fuel control valve that opens and closes a fuel path. When the pressure drops in the fuel chamber 320 as fuel is fed from the chamber 320 into the air intake 305, the metering portion of the fuel pump and metering diaphragm is biased upward, biasing the inlet needle downward or away from the control valve to open the control valve and allow fuel to flow through the fuel path into the fuel chamber 320. When the pressure rises in the fuel chamber 320 due to the flow of fuel into the chamber 320, the metering portion of the fuel pump and metering diaphragm is biased downward, biasing the inlet needle upward or toward the control valve to close the control valve. In this manner, the fuel chamber 320 is always kept at a constant pressure.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

In the description above, for purposes of explanation only, specific nomenclature is set forth to provide a thorough understanding of the present disclosure. However, it will be apparent to one skilled in the art that these specific details are not required to practice the teachings of the present disclosure.

The various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter.

It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art. For example, the reader is to understand that the specific ordering and combination of process actions described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed:

1. A carburetor comprising a body with an air intake path extending there through, a constant pressure fuel chamber formed in the body of the carburetor, a main fuel jet in fluid communication with the air intake path and the constant pressure fuel chamber, wherein the main fuel jet is releasably coupled to body of the carburetor; and a fuel pump, wherein the fuel pump and the constant pressure fuel chamber are positioned on the same side of the body.

2. The carburetor of claim 1 further comprising a check valve mounted within the body and a jet retainer releasably coupling the main fuel jet to the check valve.

3. The carburetor of claim 2 wherein the check valve includes a valve body, and a valve seat extending inward toward a center of the body.

4. The carburetor of claim 3 wherein the check valve further comprises a check valve retainer seated in a recess in the valve body of the check valve.

5. The carburetor of claim 1 wherein the check valve retainer comprising a plurality of axially extending stops.

6. The carburetor of claim 1 further comprising a nozzle having a base seated in the recess of the valve body to retain the check valve retainer.

7. The carburetor of claim 1 wherein the check valve retainer of the base of the nozzle comprising a plurality of axially extending stops.

8. A carburetor comprising a body, an air intake path in the body, a fuel pump, a metering chamber in fluid communication with the fuel pump and the air intake path, wherein the fuel pump and the metering chamber are positioned on the same side of the body, a main fuel jet in fluid communication with the metering chamber and releasably mounted within the body, and a fuel pump and metering chamber diaphragm sandwiched between the body of the carburetor and a pump cover.

9. The carburetor of claim 8 wherein the base of the nozzle comprising a plurality of axially extending stops.

10. The carburetor of claim 8 further comprising a jet retainer releasably coupling the main fuel jet to the check valve mounted within the body.

11. The carburetor of claim 8 wherein the diaphragm separates a pump chamber from a pulse chamber of the fuel pump and separates a fuel chamber from an air chamber in the metering chamber.

12. The carburetor of claim 11 further comprising inlet and outlet flapper valves.

13. The carburetor of claim 12 wherein the inlet and outlet flapper valves are formed in the diaphragm.

14. The carburetor of claim 12 further comprising a separate flapper valve member comprising the inlet and outlet flapper valves and positioned between the body and the diaphragm.

15. The carburetor of claim 12 further comprising a gasket interposing the diaphragm and the pump cover.

16. The carburetor of claim 12 wherein the diaphragm includes a pump portion and a metering portion.

17. The carburetor of claim 16 wherein the diaphragm includes a first portion comprising the pump portion and a second portion comprising a metering portion.

* * * * *